United States Patent [19]

Raar et al.

[11] Patent Number: 5,005,999

[45] Date of Patent: Apr. 9, 1991

[54] INK CASSETTE WITH CONTROL MEANS FOR ALTERNATELY DRIVING ONE OF TWO SPOOL BEARING THEREIN

[75] Inventors: Hans Raar, Cuyk; Jan Kelders, Elshout, both of Netherlands

[73] Assignee: Merlin C.T.C. Production Division Nederland B.V., Zevenaar, Netherlands

[21] Appl. No.: 323,828

[22] Filed: Mar. 15, 1989

[30] Foreign Application Priority Data

Mar. 16, 1988 [NL] Netherlands ..... 8800650

[51] Int. Cl.[5] ..... B41J 35/28

[52] U.S. Cl. ..... 400/208; 400/239; 400/221

[58] Field of Search ..... 400/207, 208, 208.1, 400/219.5, 221, 221.1, 236.2, 239, 242, 243

[56] References Cited

U.S. PATENT DOCUMENTS

| | | | |
|---|---|---|---|
| 584,497 | 6/1897 | Eckels | 400/219.5 |
| 946,359 | 1/1910 | Hess | 400/242 X |
| 2,257,553 | 9/1941 | Hept | 400/221.1 X |
| 3,045,800 | 7/1962 | Landgraf | 400/208.1 |
| 3,990,563 | 11/1976 | Adamek et al. | 400/242 X |
| 4,231,667 | 11/1980 | Behrendt et al. | 400/208 |
| 4,272,202 | 6/1981 | Schroeder et al. | 400/208 |
| 4,279,390 | 7/1981 | Wu et al. | 400/208 X |
| 4,294,553 | 10/1981 | Wuthrich | 400/219.1 |
| 4,307,969 | 12/1981 | Daughters | 400/208 |
| 4,367,963 | 1/1983 | Daughters | 400/207 X |
| 4,449,837 | 5/1984 | Craft | 400/208 |
| 4,687,357 | 8/1987 | Katsuragi et al. | 400/208 |
| 4,720,202 | 1/1988 | Kawakami | 400/208 |

FOREIGN PATENT DOCUMENTS

| | | | |
|---|---|---|---|
| 0097566 | 1/1984 | European Pat. Off. | 400/236.2 |
| 3623817 | 1/1988 | Fed. Rep. of Germany | 400/208 |
| 3623819 | 1/1988 | Fed. Rep. of Germany | 400/208 |
| 0167488 | 12/1981 | Japan | 400/221 |
| 0011386 | 1/1985 | Japan | 400/208 |
| 0228181 | 11/1985 | Japan | 400/208 |

*Primary Examiner*—Edgar S. Burr
*Assistant Examiner*—Ren Yan
*Attorney, Agent, or Firm*—Watson, Cole, Grindle & Watson

[57] ABSTRACT

An ink ribbon cassette includes two rotatable bearings for respective spools, a drive system for alternately rotating one or the other of the two bearings so that a ribbon extending between the spools positioned on the bearings will be moved in opposite directions depending on which bearing is being rotated, and a control system for controlling which bearing is being driven by the drive system based on actuation by respective trip elements on the ribbon near its opposite ends.

4 Claims, 5 Drawing Sheets

INK CASSETTE WITH CONTROL MEANS FOR ALTERNATELY DRIVING ONE OF TWO SPOOL BEARING THEREIN

BACKGROUND AND SUMMARY OF THE INVENTION

Ink casettes, used in typewriters and/or printing units for word processors or computers and the like, whether or not provided with an ink reservoir for the ribbon, are usually replaced entirely. However, this procedure is expensive in practice, since a construction still per se of value is thrown away even when the print blackness of the ribbon is no longer satisfactory. Also unnecessary pollution of the environment results.

With an ink cassette according to the present invention, the spools and the ribbon can be replaced. If required, the entire cassette can also be replaced.

The following references from the prior art do not disclose an ink cassette according to the present invention and/or preferred embodiments thereof:

U.S. Pat. No. 4,687,357 (KATSURAGI et al.);

U.S. Pat. No. 4,720,202 (KAWAKAMI, MASANORI);

U.S. Pat. No. 3,990,563 (ADAMAK et al.);

U.S. Pat. No. 2,257,553 (J.A. HEPT);

-JP-A-60/011386 (KOUICHI TAKEDA).

Usually, a printer or typewriter is provided with a shaft driven in one direction only. According to the preferred embodiment of the invention the transport direction of the ribbon is changed automatically at the end of the ribbon, whereby efficient use of the ribbon can be achieved.

The preferred embodiment provides a cost efficient cassette because most parts thereof can be made of plastic material, yet nevertheless provide a good strength and stiffness for the operation of the cassette.

Further advantages, characteristics and details of the invention will become clear with reference to the accompanying drawings.

BRIEF DESCRIPTIONS OF THE DRAWINGS

DETAILED DESCRIPTION OF THE PREFERRED EMBODIMENTS

Figure 1:
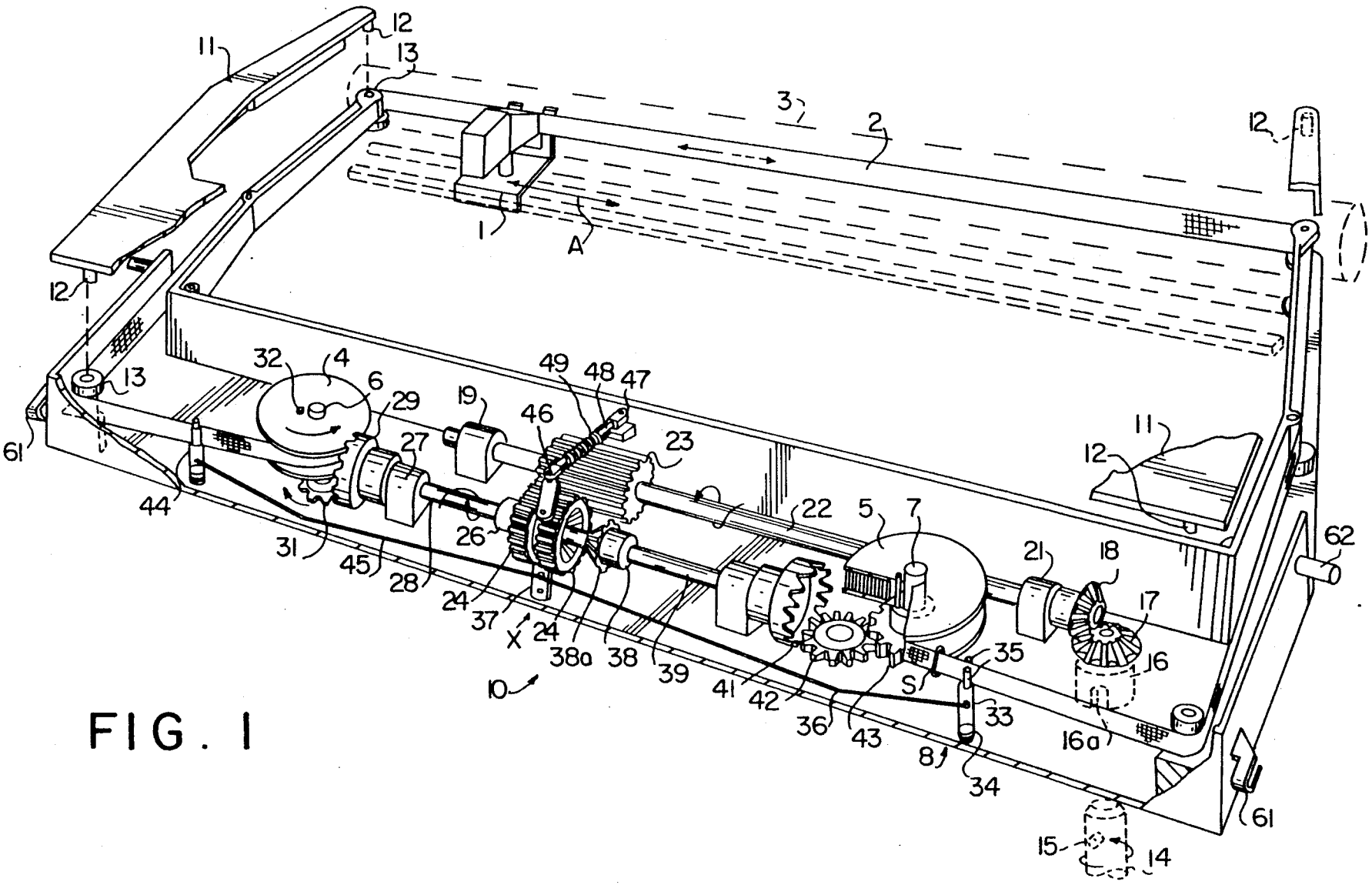
FIG. 1 shows a perspective, partly broken away view of a first preferred embodiment of the present invention.

A matrix printer head 1 (FIG. 1) can move in two directions according to arrow A and as schematically indicated with dotted lines, and transfers symbols via a ribbon 2 onto a platen 3 to be provided with a sheet of paper and indicated schematically by dotted lines. The printer head 1 can of course also be a so-called daisy wheel printer head.

The ribbon 2 is transported between spoils 4,5 which are mounted for rotation on the respective pins 6,7 in a housing 8 of a cassette 10. A closing cover 11 provided with pins 12 can be placed on the housing 8. The pins 12 fall into sleeves 13 which in the embodiment shown are also used to guide the ribbon 2.

The driving of the ribbon is provided by a schematically indicated shaft 14 provided with a catch 15 which is to be inserted in the cassette and which forms part of the typewriter or printer unit in which the cassette is to be placed. The housing 8 is provided on both sides with attachment elements in the form of a catch 62 and a hook 61 for the snapping into place thereof in a printer unit. The catch 15 can be inserted into a slot **16*a* of a pinion 16 so that the shaft 14 is coupled for driving to a bevel gear wheel 17. Mounted via a bevel gear wheel 18 is a shaft 22 mounted for rotation in bearings 19 and 21 and provided with a relatively broad toothed wheel 23 extending lengthwise of shaft 22**.

A divided tooth wheel 24 can slide along the teeth and grooves of the toothed wheel 23. In the drawn position the tooth wheel 24 is coupled via an internal bevel gear (not shown but similar to element **38*a*) to an only partly visible bevel gear wheel 26 so that the shaft 28 mounted in bearing 27 is rotated in a direction indicated by the arrow. Connected to the shaft 28 is a toothed pinion 29 which engages with a drive member 31 in the form of a toothed wheel which engages with a lower spool (not shown but similar to element 43) embodied as a toothed wheel which is joined to spool 4 via a locking pin 32 so that the spool 4 is rotated around the pin 6 in the direction indicated by the arrow and the ribbon 2 is transported at a substantially constant speed in the direction of the drawn arrow, at least in the case of driving by means of shaft 14**.

In the position shown the ribbon is transported from spool 5 to spool 4. Arranged at he end of the ribbon 2 is a trip means such as a thickening or staples which will cause an arm 33 to pivot relative to a bearing pin 34 via two pins 35. Elements 33–35 constitute a catch means. An only partly visible fork 37 is now actuated via a rod 36, which fork causes the divided tooth wheel 24 to slide along the toothed wheel 23, i.e., to the right in FIG. 1. The fork 37 is pivotable around axis X. As a result of this sliding of the divided tooth wheel 24 onto the bevel gear **38*a* of bevel gear wheel 38, the spool 5 will be rotated around the pin 7 via the shaft 39, toothed pinion 41, tooth wheel 42 and tooth wheel 43 in a direction opposite to the directions indicated with arrows in the figure. The ribbon will therefore be subsequently transported onto spool 5 from spool 4. At the end of the ribbon 2 on spool 4 trip means such as a thickening or staple is also arranged which will cause the direction of movement of the ribbon to reverse again in similar fashion via arm 44, rod 45 and fork 37**.

Preferably arranged on fork 37 for pivoting at pins 46 and 47 between the fork 37 and the housing 8 is a rod 48, around which a pressure spring 49 is placed. The rod is slidable related to pin 46 when the transport direction of the ribbon 2 is changed this pressure spring 4 will slide the divided tooth wheel 24 in accelerated manner along the toothed wheel 23 and keep it in an extreme position as this pressure spring 49 is only operative from the central position (now shown) of the divided tooth wheel 24.

As the rods 36 and 45 take a light and slightly curved form and given a suitable choice of the moments of force relative to the respective pivot points of the arms on which these rods 36,45 are arranged, there can take place a sliding movement of the tooth wheel 24 along toothed wheel 23 which in the first instance is somewhat slowed but thereafter is performed in accelerated manner because of the resilience of the rods.

The transport direction of the ribbon will continue to be changed until such time as the blackness transmitted to the paper is insufficient; the spools 4,5 can then be easily exchanged after removal of the cover 11, while the drive mechanism arranged in the cassette can be used again for the new ribbon spools to be inserted. Should the drive mechanism, which in practice is not usually of an expensive type, be worn, then the entire cassette can be replaced by a new one.

In a detail of another preferred embodiment according to the present invention (FIG. 2), the driving movement is transmitted from a disc wheel 71 for accommodation in the housing (not shown) of an ink cassette via a belt 72 on disc wheels 73 and 74 on spools 77 and 78, with the respective interpositioning of wheels 75 and 76, respectively. The ink ribbon 79 extends between spools 77 and 78 in a manner not shown.

Figure 2:
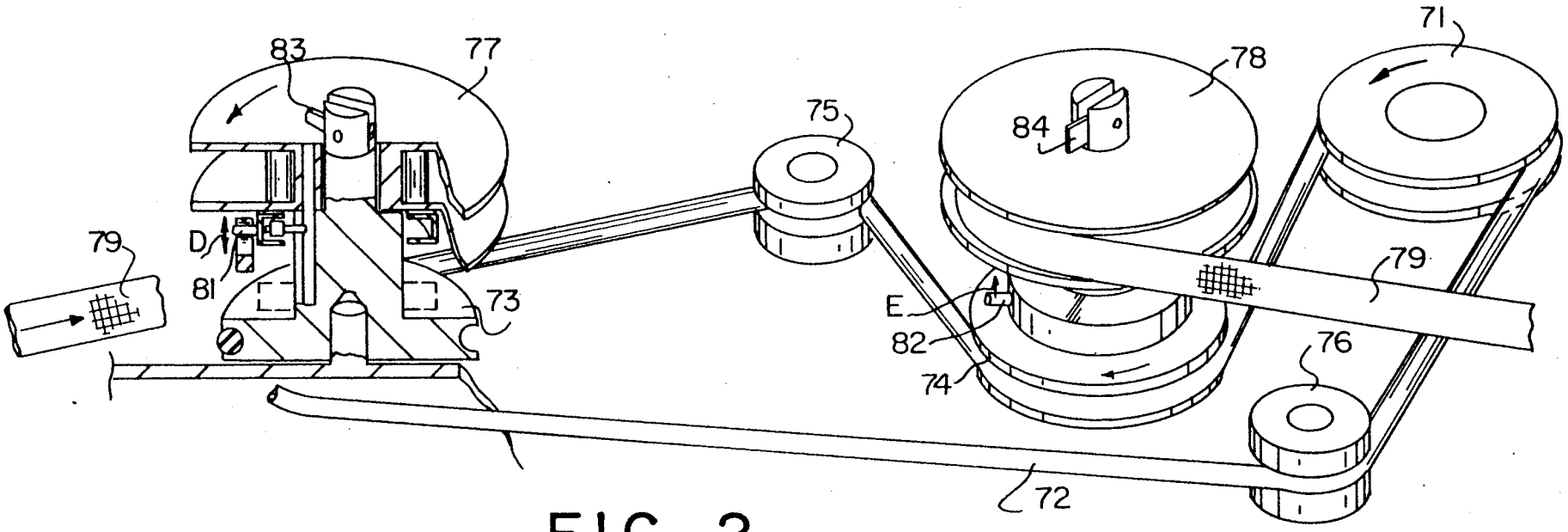
FIG. 2 is a perspective, schematic and partly broken away detail of a second preferred embodiment according to the present invention.

In the position shown in FIG. 2, spool 77 is coupled with disc wheel 73 via catch 81 so that the ribbon 79 is wound onto spool 77. Spool 78 can rotate freely.

When the ribbon is transported from spool 78 wholly onto spool 77, catch 81 will be moved in a manner not shown downward in the direction of arrow D while the control catch 82 is moved in the direction of arrow E so that wheel 74 and spool 78 are then coupled, while wheel 73 and spool 77 are disconnected and the transporation of the ribbon 79 in the direction opposite to the previous direction will occur. The spools 77 and 78 are locked against upward movement using pivotable catches 83 and 84, respectively.

In another preferred embodiment of a cassette 86 (FIG. 3A, 3B) of the present invention, which is, e.g. especially suited for a printer from the NEC Corporation, a rotating shaft (not shown) of the printer will be inserted through opening 87 and therewith impart a rotating movement in the direction of arrow F on tooth wheel 88 which is engaged to tooth wheel 89. Tooth wheel 89 is engaged with tooth wheel 91 which in turn is engaged with tooth wheel 92 with which an upper tooth wheel 93 is integrally formed. In the position shown in FIGS. 3A,3B a planet wheel 94 is engaged with upper wheel 93 and wheel or gear 96 which is provided around a shaft 97 provided with teeth or splines 98 for sliding thereon a spool 121 (FIG. 3A) for ribbon.

In the shown position (FIGS. 3A,3B) therefore the spool 121 coupled with tooth wheel 96 is driven by the shaft from the printer.

Brake spring 102 acts as a resisting or braking element for keeping the spool on a fixed position if no movement is imparted from the printer to the cassette, thereby tensioning the ribbon.

A housing 103 may be provided with an upper cover 104 and sidewalls 106, which may be pivotable sidewardly such as to be able to easily insert a new ribbon onto spools. As noted before, the first spool 121 should be slid onto teeth 98 whereas a second spool 119 should be slid onto over teeth or splines 108*a* of wheel or gear 108 mounted on shaft 109.

The cassette 86 may or may not be provided with an ink roll 109 and a transfer roll 111 for supplying ink from ink roll 109 to ribbon 101. The ink assembly 172 is pivotally mounted on shaft 113. A free end 114 of lever 116 is provided with a shaft 117 by means of which a brake spring 118 is held to wheel or gear 108. Further spring 118 presses transfer roll 111 against ribbon 101 at movement in both winding directions thereof.

After spools 119, 121 provided with ribbon 101 are disposed in the cassette 86, two slides or stops 122,123 are slid over the ribbon 101.

Figure 3A:
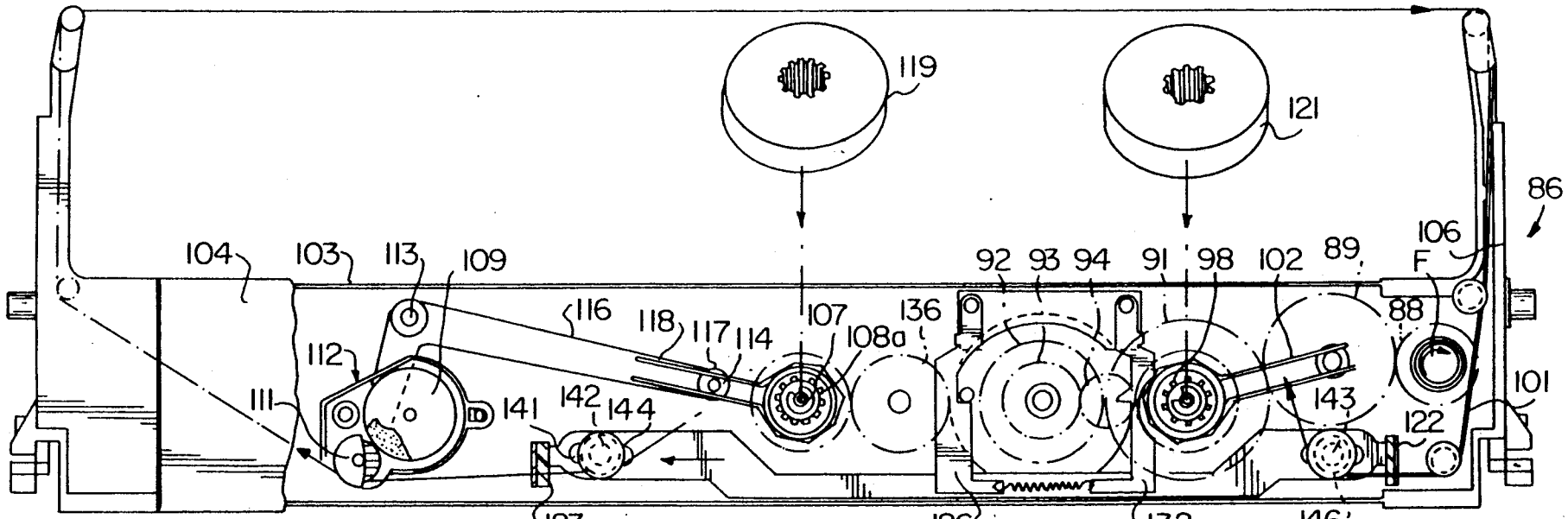
FIGS. 3A and 3B show views from above and in section respectively of another preferred embodiment of the present invention.
Figure 3B:
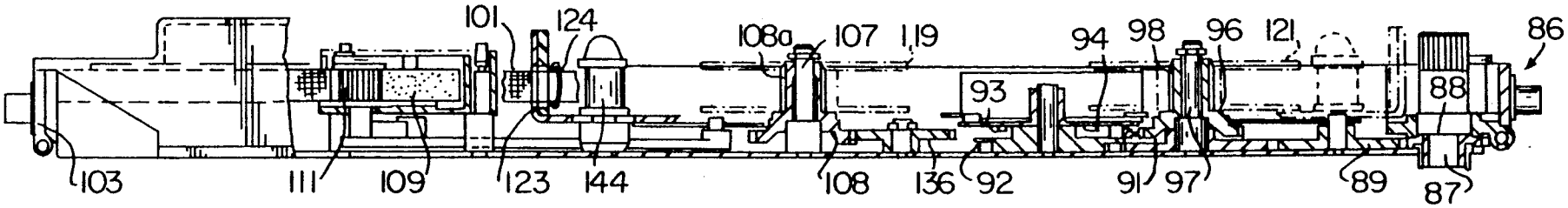
Figure 4:
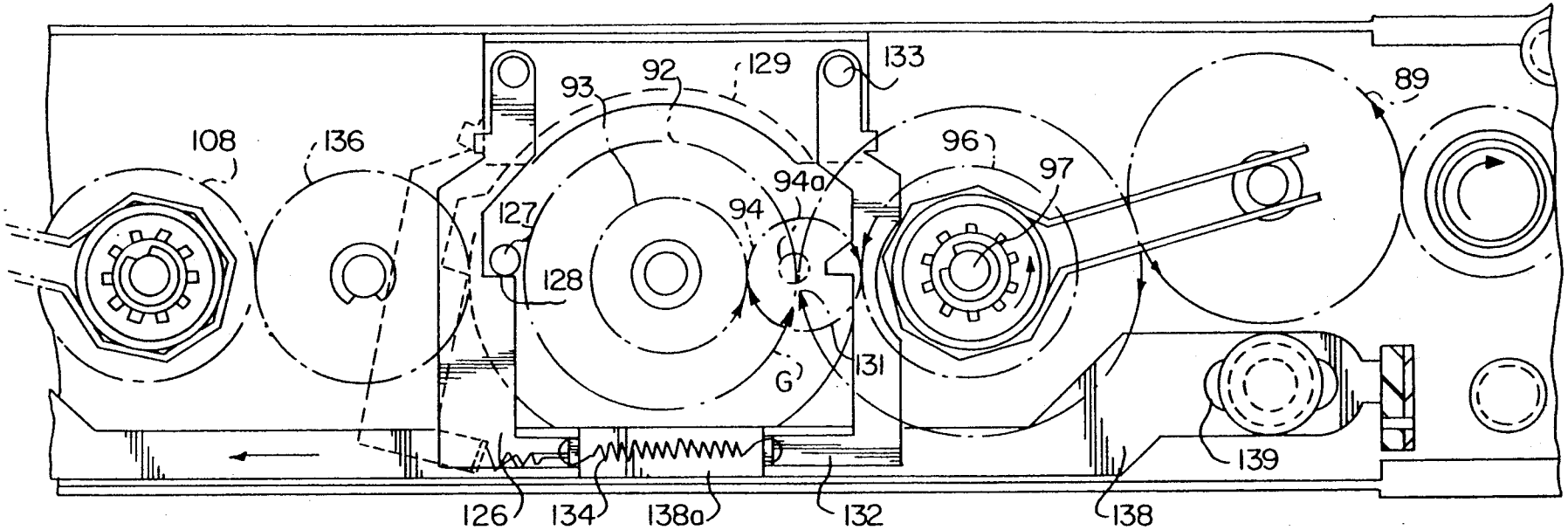
FIGS. 4–7 are details of the preferred embodiment of FIGS. 3A and 3B, clarifying the operation of this emboldiment.
Figure 5:
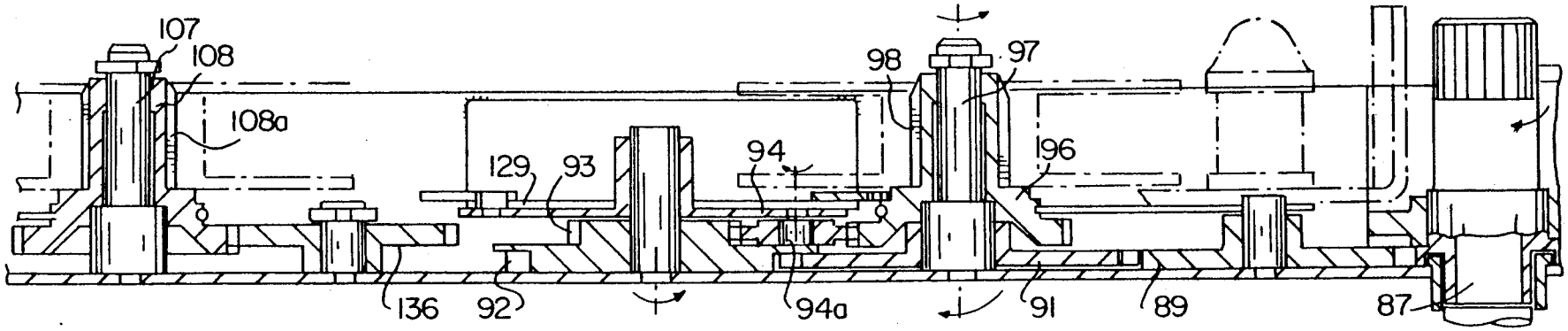
Figure 6:
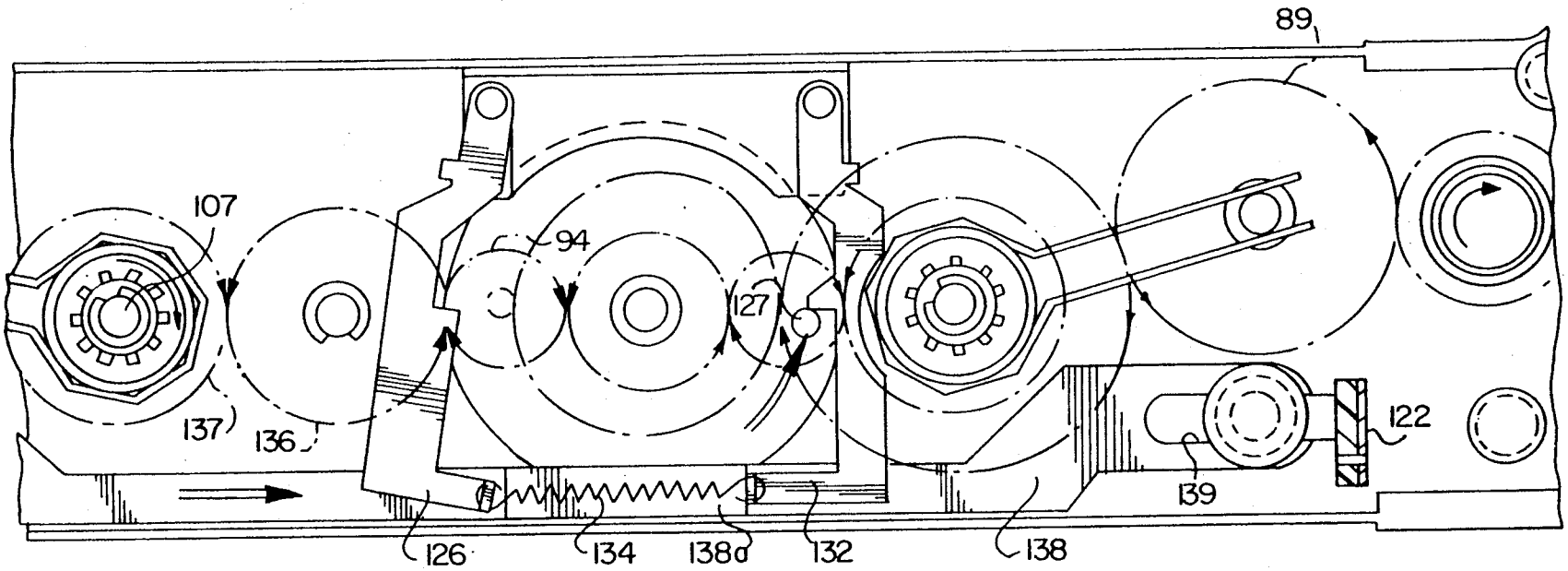
Figure 7:
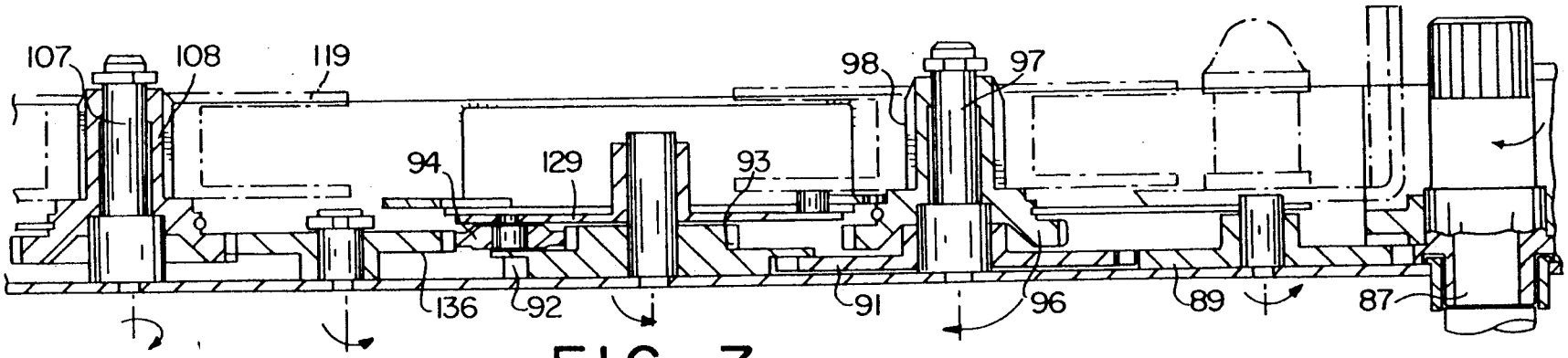

If a staple 124 or other trip element projecting from the ribbon reaches slide or stop 123, a lever 126 is moved into the position in ghost lines (FIG. 4) whereby a catch 127 is loosened from abutment 128 of lever 126, such that an upper wheel 129 on which catch 127 is mounted at the upper side and on which other side a shaft 94*a* for planet wheel 94 is mounted, is rotated according to arrow G resulting from forces exerted by planet wheel 94 on upper wheel 129. Therefore catch 127 is moved until it reaches abutment 131 on lever 132 which is pivotally mounted on a shaft 133 (see also FIGS. 6,7). Lever 126 is pulled back by spring 134 mounted between the ends of lever 126 and lever 132. When catch 127 reaches abutment 131, planet wheel 94 will engage a wheel 136 which is engaged with wheel 108 disposed on axis 107, such that spool 119 will be rotated and directly driven from wheel 94 in the direction opposite to the direction as indicated in FIG. 3A, such that the ribbon also will be transported in the opposite direction.

As the other end of the ribbon 101 is also provided with a trip element, the above described operation is reversed when this trip element contacts slide or stop 122 for automatically reversing the movement of the ribbon. The lever or extended element 138 on which slides or stops 122,123, are mounted is provided with slots 139,141 through which axes 142,143 are extended, such that rollers 144,146 resp. for guiding the ribbon 101 can be mounted thereon.

Lever 138 is mounted under levers 126,132 and is provided with a projecting part 138*a* such as to operate the levers 126,132, resp.

It is noted that the preferred embodiment according to FIGS. 3–7 provides a very compact structure, also necessary because of he limited space available, e.g., in the NEC printer.

Especially the forces exerted on element 138 are such that this element should have a considerable width if made from plastic.

In the shown embodiment this element 138 can be made thick and stiff enough, as there is enough space available in the cassette for that element 138.

The embodiments shown can easily be provided with new spools and a ribbon, by guiding the ribbon from one spool through the cassette. This can be simplified, e.g., by drawing or writing instructions on the cover of the cassette. It is noted that especially a spool provided with slots or grooves and teeth (or counter splines) can be easily slid onto a corresponding shaft.

The present invention is not limited to the shown embodiments; the position of the spools and gearings can be varied according to required dimensioning, e.g., determined by the design of the printer and other requirements such as for closure and attachment.

We claim:

1. An ink ribbon cassette for use in a printing device having a rotatable driver means and for use with first and second spools having an ink ribbon connected therebetween, said ink ribbon including trip means located near opposite ends thereof, said cassette comprising:

a housing, spaced first and second bearing means rotatably mounted in said housing to respectively mount said first and second spools, drive means mounted in said housing for alternatively rotating said first bearing means in a first rotational direction and said second bearing means in a second, opposite rotational direction and cause said first and second spools, when mounted on said first and second bearing means, to rotate and move said ink ribbon extending therebetween in alternatively first and second traveling directions within said housing, said drive means comprising a first shaft which is fixedly mounted on said housing and is rotatable by said rotatable driver means of said printing device, a toothed wheel having longitudinal grooves mounted on said first shaft, a second shaft which is fixedly mounted on said housing and which extends in parallel with the first shaft and mounts a tooth wheel having longitudinal grooves that are engaged with the longitudinal grooves of the toothed wheel on the first shaft, a first gear means for driving the first bearing means, and a second gear means for driving the second bearing means, the tooth wheel being slidable along the second shaft between a first position wherein the tooth wheel is in engagement with said first gear means and a second position wherein the tooth wheel is in engagement with said second gear means, and control means mounted in said housing and through which said ink ribbon that extends between said first and second spools mounted on said first and second bearing means can pass, said control means controlling whether said tooth wheel is in said first position or said second position, based on actuation by said trip means.

2. An ink ribbon cassette according to claim 1, wherein the first shaft mounts a first bevel gear wheel at one end thereof and wherein the drive means further includes a pinion which is engagable with said rotatable driver means of said printing device and which includes a second bevel gear wheel which is engaged with the first bevel gear wheel.

3. An ink ribbon cassette according to claim 1, wherein said control means comprises first and second latch means mounted in said housing near the first and second bearing means and through which the ribbon extending from the first spool to the second spool can respectively pass, an actuator rod connected between the first and second latch means, and a fork connector which is connected to the actuator rod and is engaged with the tooth wheel, such that contact by said trip means on the ribbon against the first or second latch means will result in the actuator rod being moved so as to cause the fork connector to move the tooth wheel between its first and second positions.

4. An ink ribbon cassette for use in a printing device having a rotatable driver means and or use with first and second spools having an ink ribbon connected therebetween, said ink ribbon including trip means located near opposite ends therof, said cassette comprising:

a housing, spaced first and second bearing means rotatably mounted in said housing to respectively mount said first and second spools, drive means mounted in said housing for alternatively rotating said first bearing means in a first rotational direction and said second bearing means in a second, opposite rotational direction and cause said first and second spools, when mounted on said first and second bearing means, to rotate and move said ink ribbon extending therebetween in alternatively first and second traveling directions within said housing, said drive means including a tooth wheel rotatably mounted in the housing between the first and second bearing means and being cooperable and drivable by said rotatable driver means of said printing device, said tooth wheel mounting a rotatable planet wheel which is alternately engagable with said first and second bearing means, and control means mounted in said housing and through which said ink ribbon that extends between said first and second spools mounted on said first and second bearing means can pass, said control means controlling whether said drive means rotates said first bearing means or said second bearing means based on actuation by said trip means.

* * * * *